US007710385B2

(12) United States Patent
Lee et al.

(10) Patent No.: US 7,710,385 B2
(45) Date of Patent: May 4, 2010

(54) APPARATUS AND METHOD FOR DRIVING LIQUID CRYSTAL DISPLAY DEVICE

(75) Inventors: Seok Woo Lee, Seoul (KR); Hyun Jin So, Seoul (KR)

(73) Assignee: LG Display Co., Ltd., Seoul (KR)

( * ) Notice: Subject to any disclaimer, the term of this patent is extended or adjusted under 35 U.S.C. 154(b) by 803 days.

(21) Appl. No.: 11/642,859

(22) Filed: Dec. 21, 2006

(65) Prior Publication Data

US 2007/0296680 A1 Dec. 27, 2007

(30) Foreign Application Priority Data

Jun. 23, 2006 (KR) ..... 10-2006-0056859

(51) Int. Cl.
*G09G 3/36* (2006.01)

(52) U.S. Cl. ..... 345/100; 345/87

(58) Field of Classification Search ..... 345/87–100, 345/204

See application file for complete search history.

(56) References Cited

U.S. PATENT DOCUMENTS 5,659,331 A * 8/1997 Oh et al. ..... 345/95
7,432,902 B2 * 10/2008 Yun ..... 345/96
2003/0048246 A1 3/2003 Ham
2005/0156851 A1 * 7/2005 Yun ..... 345/98
2006/0017713 A1 1/2006 Lee et al.
2006/0125718 A1 * 6/2006 Weitbruch et al. ..... 345/60
2007/0040847 A1 * 2/2007 Thebault et al. ..... 345/616
2008/0001910 A1 * 1/2008 Lim ..... 345/102
2009/0219279 A1 * 9/2009 Ishii et al. ..... 345/214

FOREIGN PATENT DOCUMENTS

EP 1 669 975 6/2006
JP 10-082985 3/1998

* cited by examiner

*Primary Examiner*—Nitin Patel
(74) *Attorney, Agent, or Firm*—McKenna Long & Aldridge LLP

(57) ABSTRACT

An data driver for driving an LCD device includes a modulator that generates modulated data from input data; and a control circuit to selects between converting the modulated data to first analog data of a driving output and converting the input data to second analog data of the driving output, and to supply the driving output to the plurality of data lines. The driving output may provide a gray-to-gray response time of the LCD device substantially the same as one of a black-to-white and a white-to-black response time of the LCD device by reducing actual liquid crystal response time of the LCD device.

44 Claims, 7 Drawing Sheets

APPARATUS AND METHOD FOR DRIVING LIQUID CRYSTAL DISPLAY DEVICE

This application claims the benefit of Korean Patent Application No. P2006-56859, filed on Jun. 23, 2006, which is hereby incorporated by reference as if fully set forth herein.

BACKGROUND OF THE INVENTION

1. Field of the Invention

The present invention relates to a liquid crystal display (LCD) device, and more particularly, to an apparatus and method for driving an LCD device.

2. Discussion of the Related Art

Liquid Crystal Display (LCD) devices have been used in many different types of electronic equipment. The LCD devices display images by adjusting the light transmittance of liquid crystal cells according to a video signal. Active matrix type LCD devices have a switching element formed for every liquid crystal cell and are well suited for displaying moving images. Thin film transistors (TFTs) are the devices primarily used as the switching element in the active matrix type LCD device.

However, LCD devices generally have a relatively slow response speed attributable to the inherent viscosity and elasticity of a liquid crystal, as can be seen from the following Equations 1 and 2:

$$\tau_r \propto \frac{\gamma d^2}{\Delta\varepsilon|V_a^2 - V_F^2|} \qquad \text{Equation 1}$$

where $\tau_r$ is a rise time for response to a voltage is applied to the liquid crystal, Va is the applied voltage, $V_F$ is a Frederick transition voltage at which liquid crystal molecules start to be inclined, d is a liquid crystal cell gap, and $\gamma$ is the rotational viscosity of the liquid crystal molecules; and $$\tau_F \propto \frac{\gamma d^2}{K} \qquad \text{Equation 2}$$

where $\tau_F$ is a falling time for returning the liquid crystal molecules to their original positions by an elastic restoration force after the voltage applied to the liquid crystal is turned off, and K is the inherent elastic modulus of the liquid crystal.

For a twisted nematic (TN) mode LCD device, although the response speed of the liquid crystal may vary with the physical properties and cell gap of the liquid crystal, rise times of 20 to 80 ms and the falling times of 20 to 30 ms are typical. Because these typical liquid crystal response times are longer than a moving image frame period (for example 16.67 ms for moving images according to the National Television Standards Committee (NTSC) standard), the voltage charged on the liquid crystal may not reach the desired level before the next frame data is presented, as shown in FIG. 1. The slow response results in motion blurring in which an afterimage is left on the LCD display panel.

As illustrated in FIG. 1, a related art LCD device may fail to display a desired color and brightness for a moving image because, when data VD is changed from one level to another level, the corresponding display brightness level BL is unable to reach the desired value due to the slow response of the LCD device. As a result, motion blurring occurs in moving images, causing degradation in contrast ratio and display quality.

As one method for overcoming the low response speed of the LCD device, U.S. Pat. No. 5,495,265 and PCT International Publication No. WO 99/09967 propose a method for modulating data using a look-up table (referred to hereinafter as an 'over-driving method'). The principle of this over-driving method of the related art is illustrated in FIG. 2.

As may be appreciated with reference to FIG. 2, the related art over-driving method includes modulating input data VD to produce modulated data MVD, and applying the modulated data to a liquid crystal cell to obtain a desired brightness level MBL. By this method, the response speed of a liquid crystal is rapidly accelerated by increasing $|V_a^2 - V_F^2|$ in the Equation 1 for a variation in the input data from that of a previous frame period in order to obtain the desired brightness level corresponding to the luminance of the input data in one frame period.

Accordingly, a related art LCD device using the over-driving method is able to compensate for a slow response of a liquid crystal by modulation of a data value to reduce or eliminate motion blurring in a moving image to display a picture having the desired color and brightness.

In order to reduce the memory storage used in implementing over-driving, the related art over-driving method performs modulation by comparing only respective most significant bits (MSB) of a previous frame (Fn−1) and current frame (Fn) with each other, as shown in FIG. 3. In other words, the related art over-driving method compares respective most significant bit data (MSB) of the previous frame (Fn−1) and current frame (Fn) with each other to determine whether there is a variation between the two most significant bit data (MSB). If there is a variation between the two most significant bit data (MSB), the corresponding modulated data (MRGB) is selected from a look-up table as most significant bit data (MSB) of the current frame (Fn).

FIG. 4 illustrates a related art over-driving apparatus implementing the above-described over-driving method.

As illustrated in FIG. 4, the related art over-driving apparatus includes a frame memory 43 connected to a most significant bit bus line 42, and a look-up table 44 connected in common with the output terminals of the most significant bit bus line 42 and frame memory 43.

The frame memory 43 stores most significant bit data (MSB) for one frame period and supplies the stored data to the look-up table 44. In the related art over-driving apparatus of FIG. 4, the most significant bit data (MSB) includes the four most significant bits of 8-bit source data (RGB).

The look-up table 44 compares most significant bit data (MSB) of a current frame (Fn) supplied from the most significant bit bus line 42 with most significant bit data (MSB) of a previous frame (Fn−1) inputted from the frame memory 43, as in Table 1 below, and selects modulated data (MRGB) corresponding to the comparison result. The modulated data (MRGB) is combined with least significant bit data (LSB) from a least significant bit bus line 41 and then supplied to an LCD device.

Where the most significant bit data (MSB) is limited to four bits, the modulated data (MRGB) registered in the look-up table 44 of the over-driving apparatus and method is as follows:

TABLE 1

| | | Current Frame | | | | | | | | | | | | | | | |
|---|---|---|---|---|---|---|---|---|---|---|---|---|---|---|---|---|---|
| | | 0 | 1 | 2 | 3 | 4 | 5 | 6 | 7 | 8 | 9 | 10 | 11 | 12 | 13 | 14 | 15 |
| Previous Frame | 0 | 0 | 1 | 3 | 4 | 6 | 7 | 9 | 10 | 11 | 12 | 14 | 15 | 15 | 15 | 15 | 15 |
| | 1 | 0 | 1 | 2 | 4 | 5 | 7 | 9 | 10 | 11 | 12 | 13 | 14 | 15 | 15 | 15 | 15 |
| | 2 | 0 | 1 | 2 | 3 | 5 | 7 | 8 | 9 | 10 | 12 | 13 | 14 | 15 | 15 | 15 | 15 |
| | 3 | 0 | 1 | 2 | 3 | 5 | 6 | 8 | 9 | 10 | 11 | 12 | 14 | 14 | 15 | 15 | 15 |
| | 4 | 0 | 0 | 1 | 2 | 4 | 6 | 7 | 9 | 10 | 11 | 12 | 13 | 14 | 15 | 15 | 15 |
| | 5 | 0 | 0 | 0 | 2 | 3 | 5 | 7 | 8 | 9 | 11 | 12 | 13 | 14 | 15 | 15 | 15 |
| | 6 | 0 | 0 | 0 | 1 | 3 | 4 | 6 | 8 | 9 | 10 | 11 | 13 | 14 | 15 | 15 | 15 |
| | 7 | 0 | 0 | 0 | 1 | 2 | 4 | 5 | 7 | 8 | 10 | 11 | 12 | 14 | 14 | 15 | 15 |
| | 8 | 0 | 0 | 0 | 1 | 2 | 3 | 5 | 6 | 8 | 9 | 11 | 12 | 13 | 14 | 15 | 15 |
| | 9 | 0 | 0 | 0 | 1 | 2 | 3 | 4 | 6 | 7 | 9 | 10 | 12 | 13 | 14 | 15 | 15 |
| | 10 | 0 | 0 | 0 | 0 | 1 | 2 | 4 | 5 | 7 | 8 | 10 | 11 | 13 | 14 | 15 | 15 |
| | 11 | 0 | 0 | 0 | 0 | 0 | 2 | 3 | 5 | 6 | 7 | 9 | 11 | 12 | 14 | 15 | 15 |
| | 12 | 0 | 0 | 0 | 0 | 0 | 1 | 3 | 4 | 5 | 7 | 8 | 10 | 12 | 13 | 15 | 15 |
| | 13 | 0 | 0 | 0 | 0 | 0 | 1 | 2 | 3 | 4 | 6 | 8 | 10 | 11 | 13 | 14 | 15 |
| | 14 | 0 | 0 | 0 | 0 | 0 | 0 | 1 | 2 | 3 | 5 | 7 | 9 | 11 | 13 | 14 | 15 |
| | 15 | 0 | 0 | 0 | 0 | 0 | 0 | 0 | 1 | 2 | 4 | 6 | 9 | 11 | 13 | 14 | 15 |

In the above Table 1, the leftmost column represents the data voltage (VDn−1) of the previous frame (Fn−1) and the uppermost row represents the data voltage (VDn) of the current frame (Fn). The contents of Table 1 are look-up table information obtained by expressing four most significant bits in decimal form.

The related art apparatus and method for driving the LCD device is used to provide a high response speed of liquid crystal during a gray-to-gray change between previous frame and current frames. In comparison to the variation associated with a black-to-white change, the gray-to-gray change involves a relatively small voltage difference between frames, so that the liquid crystal response for each gray-to-gray change without overdriving would be slow or non-linear, resulting in poor color change in a moving image or degradation in picture quality.

In the above-described over-driving apparatus a digital memory, such as the look-up table 44, is used in the generation of modulated data (MRGB) in the comparison of the data of the previous frame (Fn−1) with that of the current frame (Fn). The use of the digital memory increases chip size as well as manufacturing costs for the LCD device.

SUMMARY OF THE INVENTION

Accordingly, the present invention is directed to an apparatus and method for driving an LCD device, which substantially obviates one or more problems due to limitations and disadvantages of the related art.

An advantage of the present invention is to provide an apparatus and method for driving an LCD device wherein a response speed of liquid crystal can be increased even without using a memory, thereby preventing degradation in picture quality.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a data driver for driving a liquid crystal display device having a plurality of data lines includes a modulator that generates modulated data from input data; and a control circuit to selects between converting the modulated data to first analog data of a driving output and converting the input data to second analog data of the driving output, and to supply the driving output to the plurality of data lines, wherein the driving output may provide a gray-to-gray response time of the liquid crystal display device substantially the same as one of a black-to-white and a white-to-black response time of the liquid crystal display device by reducing actual liquid crystal response time of the liquid crystal display device.

In another aspect of the present invention, a method for driving an LCD device having an image display unit including a plurality of liquid crystal cells formed in areas defined by a plurality of gate and data lines includes generating modifying data from at least one most significant bit of input data; generating modulated data by combining input data with the modifying data; selecting between converting the input data into an analog video signal and converting the modulated data into the analog video signal; and supplying the analog video signal to the data lines, wherein a gray-to-gray response time of the LCD device is made substantially the same as one of a black-to-white and a white-to-black response time of the LCD device by reducing actual liquid crystal response time of the LCD device.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Hereinafter, an apparatus and method for driving an LCD device according to the present invention will be explained with reference to the accompanying drawings.

Figure 1:
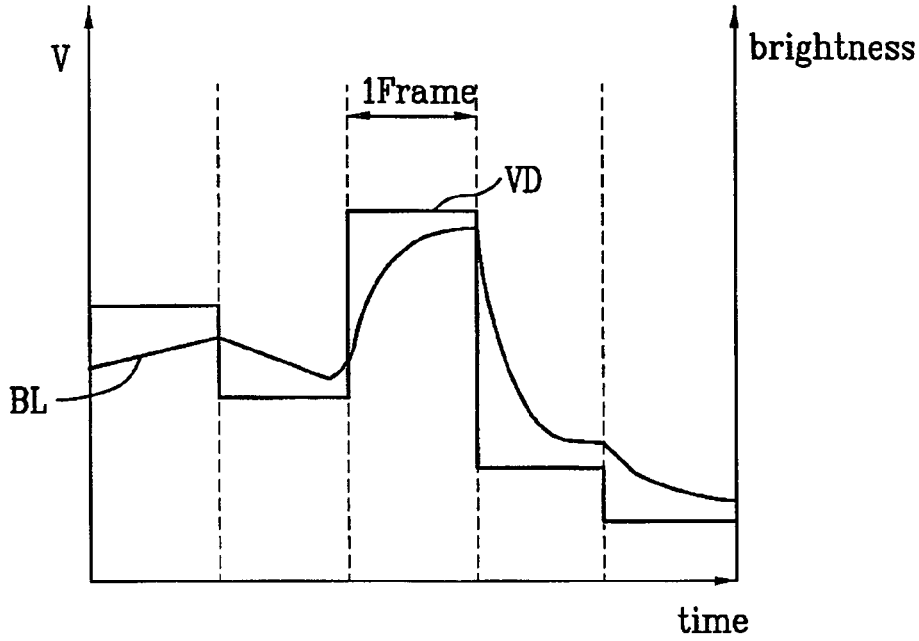
FIG. 1 Related Art
FIG. 1 is a waveform diagram illustrating a data-dependent brightness variation in a related art LCD device.
Figure 2:
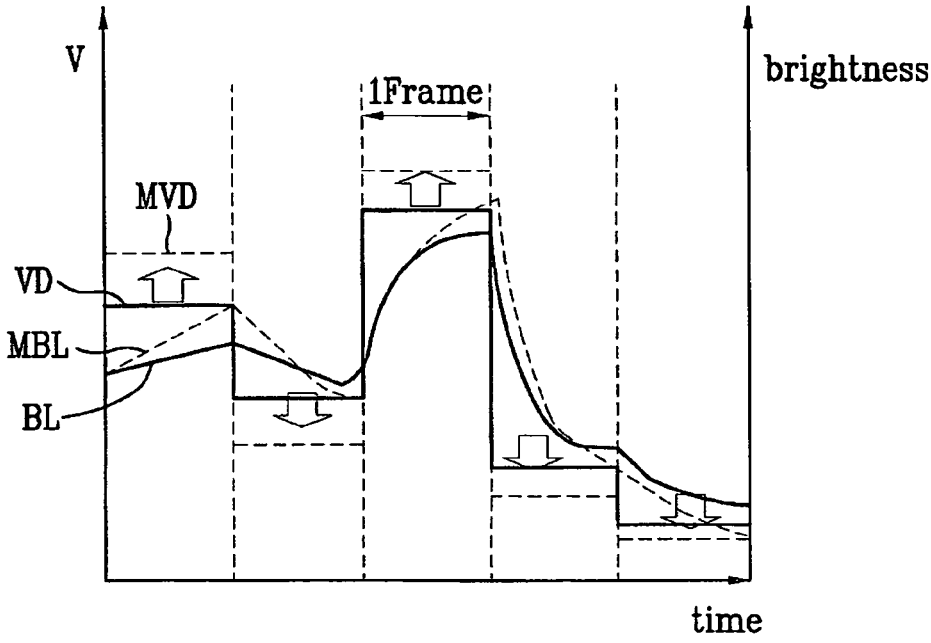
FIG. 2 Related Art
FIG. 2 is a waveform diagram illustrating a data modulation-dependent brightness variation in a related art over-driving method of an LCD device.
Figure 3:
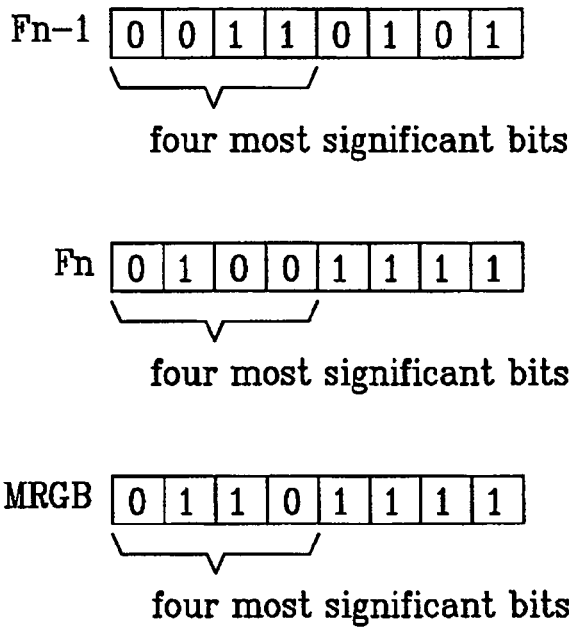
FIG. 3 Related Art
FIG. 3 is a view illustrating most significant bit data modulation in a related art over-driving apparatus of an LCD device.
Figure 4:
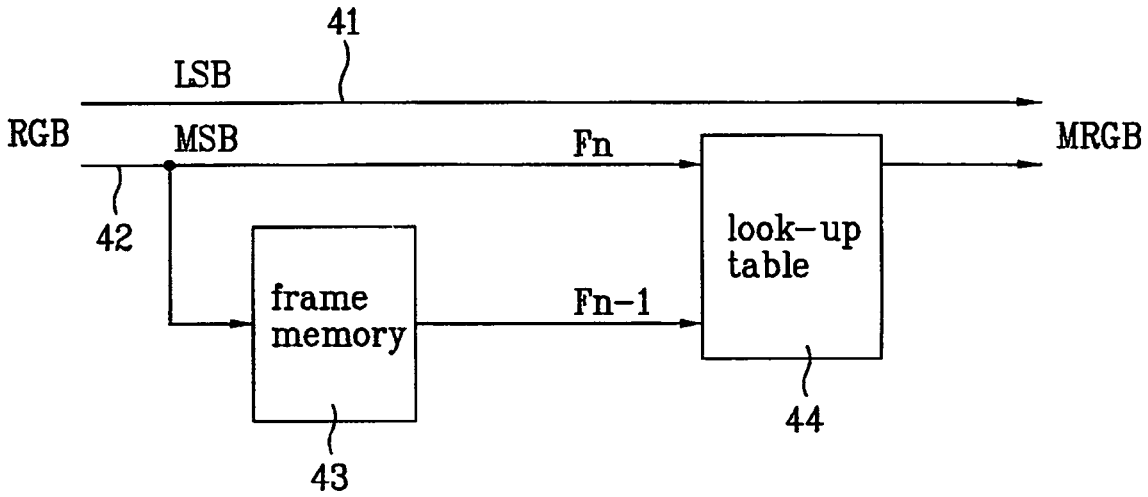
FIG. 4 Related Art
FIG. 4 is a block diagram of the related art over-driving apparatus of an LCD device.
Figure 5:
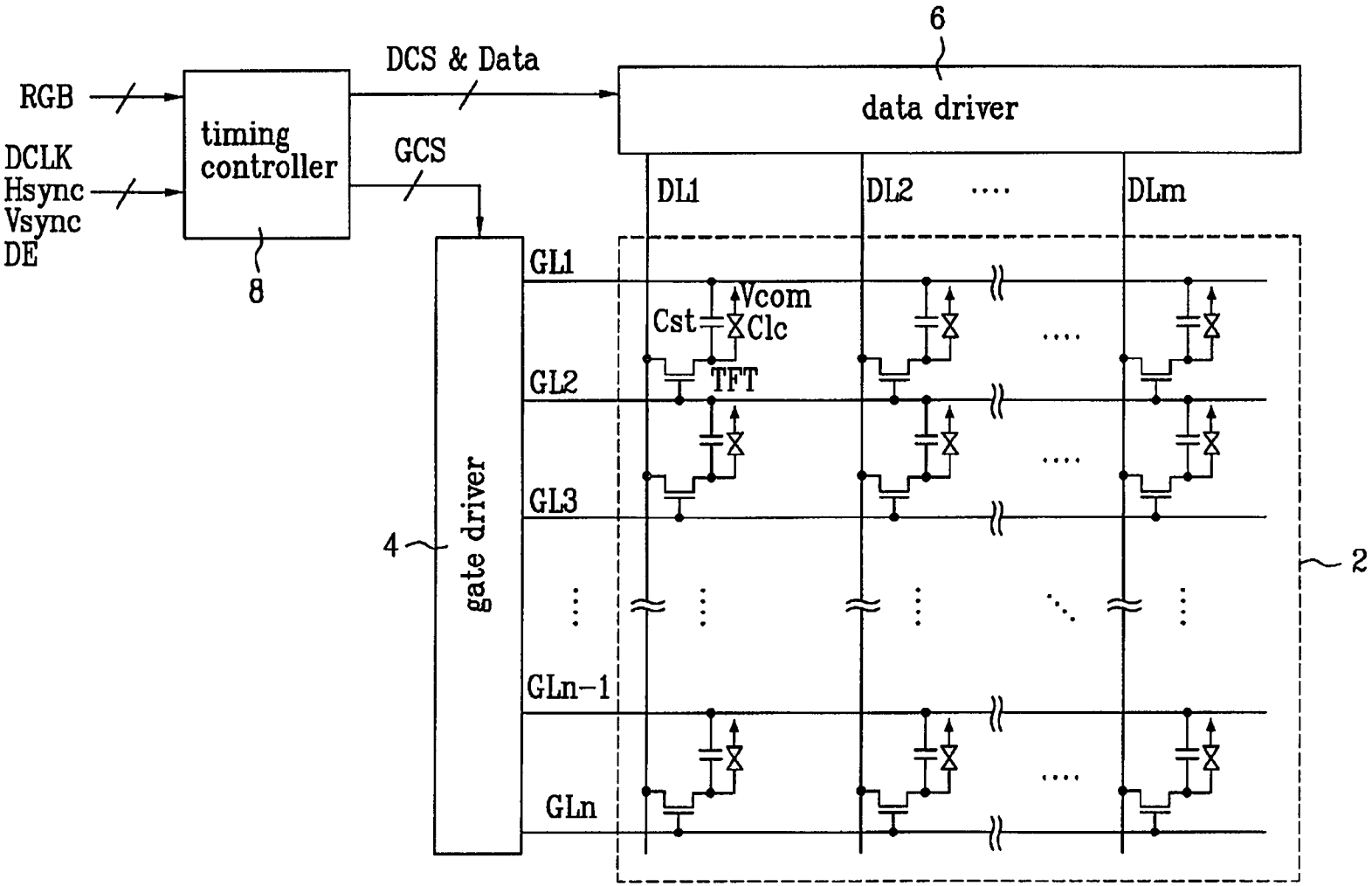
FIG. 5 is a schematic view illustrating a driving apparatus of an LCD device according to an embodiment of the present invention.

FIG. 5 is a schematic view illustrating a driving apparatus of an LCD device according to an embodiment of the present invention.

As shown in FIG. 5, the driving apparatus is provided with an image display unit 2 that includes a plurality of liquid crystal cells respectively formed in areas defined by n gate lines (GL1 to GLn) and m data lines (DL1 to DLm); a gate driver 4 that sequentially supplies a scan pulse to the gate lines (GL1 to GLn); a data driver 6 that converts i-bit input data (Data) to i-bit modulated data to enable rapid response speed of liquid crystal based on at least two most significant bit data of i-bit input data, converts the i-bit modulated data or i-bit input data to an analog video signal, and supplies the analog video signal to the data lines (DL1 to DLm) in synchronization with the scan pulse; and a timing controller 8 that arranges source data (RGB) supplied from the external, supplies the arranged source data (RGB) to the data driver 6, and controls the gate driver 4 and the data driver 6.

The image display unit 2 includes a transistor array substrate and a color filter array substrate that are bonded together; spacers to maintain a uniform cell gap between the bonded substrates; and a liquid crystal layer formed in the gap provided between the two bonded substrates and maintained by the spacers.

The image display unit 2 further includes a plurality of thin film transistors (TFT) formed at the liquid cells defined by n gate lines (GL1 to GLn) and m data lines (DL1 to DLm). The liquid crystal cells are each connected to a respective TFT. The TFTs supply the analog video signals provided from the data lines (DL1 to DLm) to the liquid crystal cells in response to the scan pulse provided from the gate lines (GL1 to GLn).

Each liquid crystal cell can be equivalently represented as a liquid crystal capacitor Clc because each liquid crystal cell is provided with a common electrode facing a pixel electrode connected to the TFT with liquid crystal between the common electrode and the pixel electrode. Each liquid crystal cell includes a storage capacitor Cst for maintaining the analog video signal charged on the liquid crystal capacitor Clc until the next analog video signal is charged thereon.

The timing controller 8 arranges source data (RGB) supplied from a source external to the LCD device to a form appropriate for driving the image display unit 2, and supplies the arranged source data (RGB) to the data driver 6. The timing controller 8 generates a data control signal (DCS) and a gate control signal (GCS) using a dot clock signal (DCLK), a data enable signal (DE), and horizontal and vertical synchronous signals (Hsync and Vsync) supplied from an external source, and applies the generated data control signal (DCS) and gate control signal (GCS) respectively to the data and gate drivers 6 and 4, to thereby control the driving timing thereof.

The gate driver 4 includes a shift register that generates a scan pulse (gate high signal) in response to the gate control signal (GCS) of the timing controller 8. The gate driver 4 sequentially supplies the gate high signal to the gate lines (GL) of the image display unit 2, to thereby turn on the TFTs connected with each gate line (GL).

The data driver 6 converts i-bit input data (Data) to i-bit modulated data to provide a rapid response speed of liquid crystal based on at least two most significant bits of i-bit input data supplied from the timing controller 8 in response to the data control signal (DCS) supplied from the timing controller 8, converts the i-bit modulated data or i-bit input data to the analog video signal, and supplies the analog video signal for one horizontal line to the data lines (DL1 to DLm) by one horizontal period supplied with the scan pulse. The data driver 6 inverts the polarity of the analog video signal supplied to the data lines (DL) in response to a polarity control signal (POL).

Figure 6:
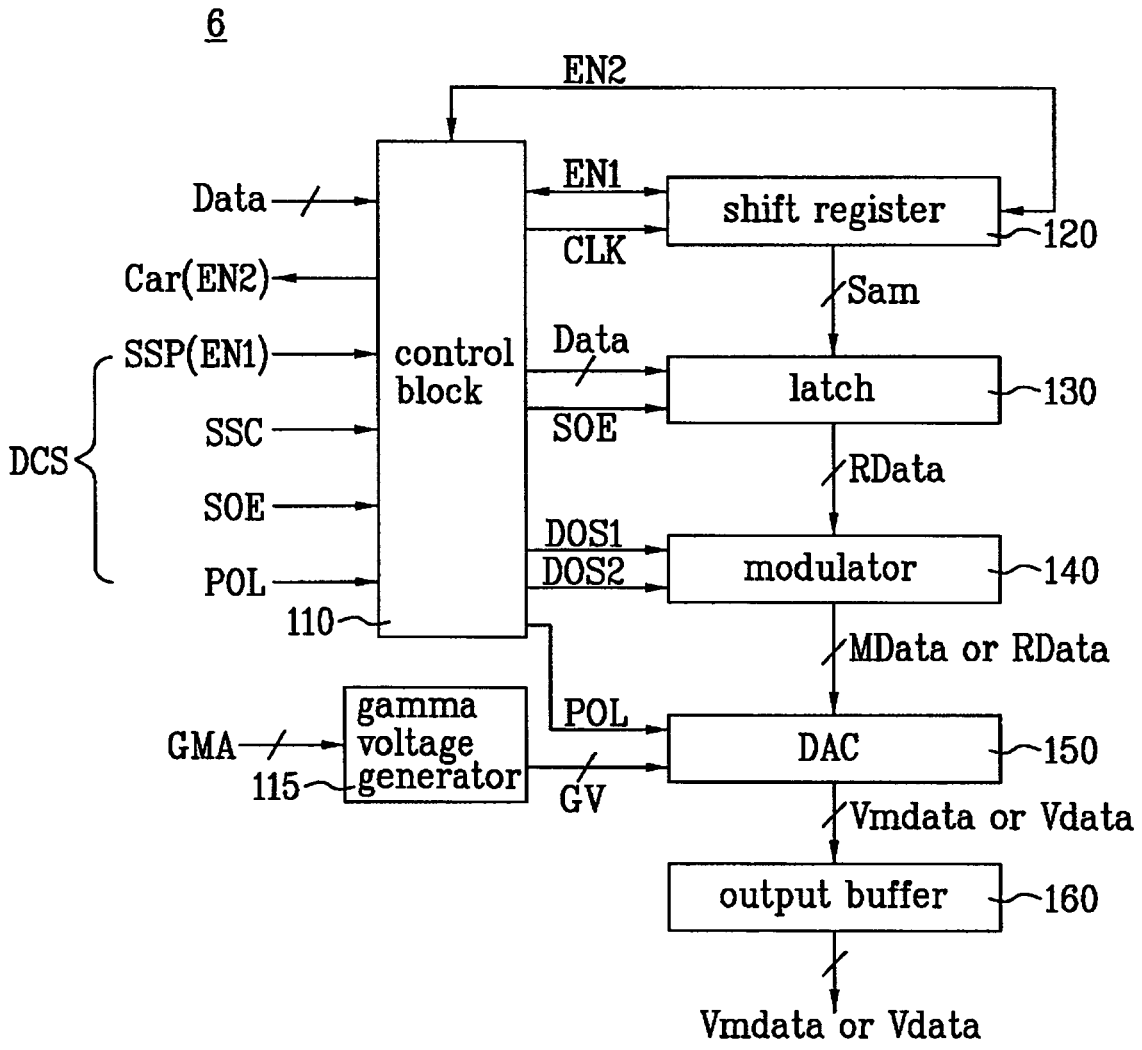
FIG. 6 is a block diagram schematically illustrating a data driver according to an embodiment of the present invention.

As shown in FIG. 6, for the purpose of supplying the analog video signal, the data driver 6 includes a control block 110, a gamma voltage generator 115, a shift register 120, a latch 130, a modulator 140, a digital-analog converter (DAC) 150, and an output buffer 160.

The control block 110 supplies the i-bit input data (Data) provided from the timing controller 8 to the latch 130, and supplies the data control signal (DCS) provided from the timing controller 8 to the shift register 120, the latch 130, and the DAC 150. The control block 110 supplies a first enable signal (EN1) corresponding to a source start pulse (SSP) and a clock signal (CLK) corresponding to a source shift clock (SSC) to the shift register 120, and outputs a second enable signal (EN2) corresponding to a carry signal (Car) outputted from the shift register 120. The control block 110 supplies a source output enable (SOE) to the latch 130, and supplies the polarity control signal (POL) to the DAC 150.

The control block 110 includes a data output signal generator that generates first and second data output signals (DOS1 and DOS2) to selectively convert the i-bit modulated data or the i-bit input data to an analog video signal by using the source output enable (SOE) provided from the timing controller 8, and supplies the generated first and second data output signals (DOS1 and DOS2) to the modulator 140.

Figure 7:
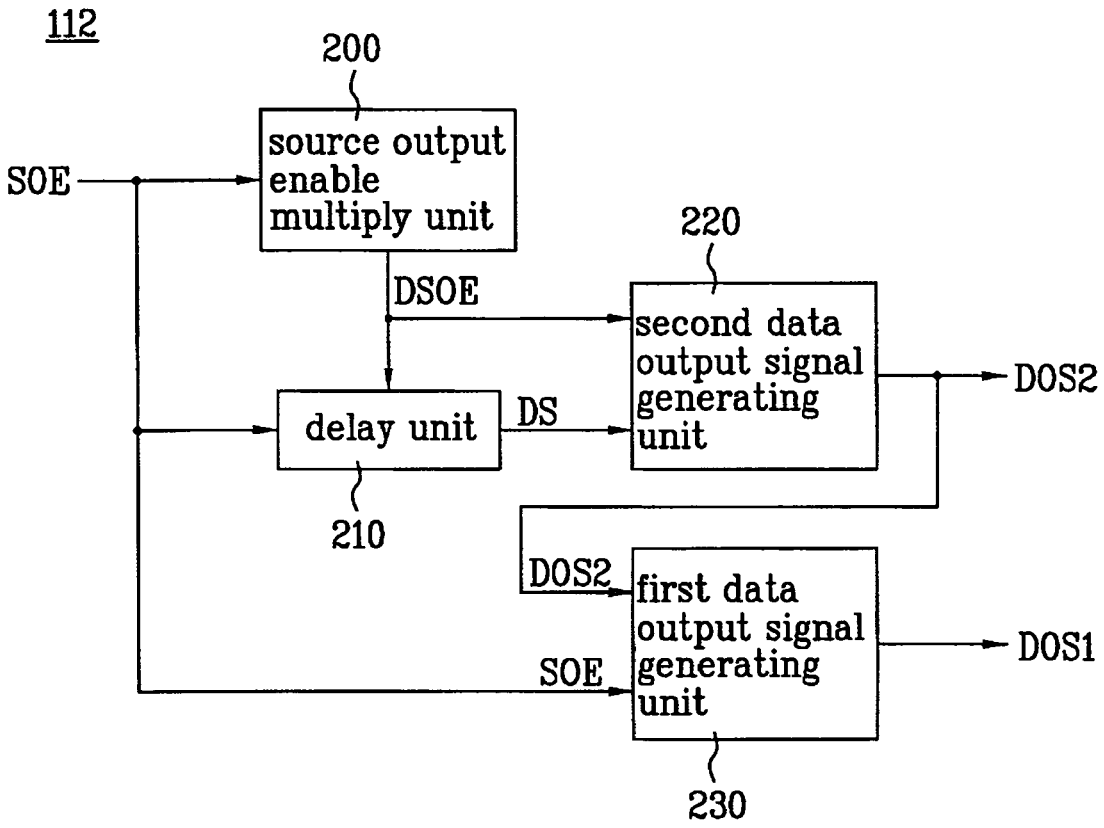
FIG. 7 is a block diagram schematically illustrating a data output signal generator according to an embodiment of the present invention.
Figure 8:
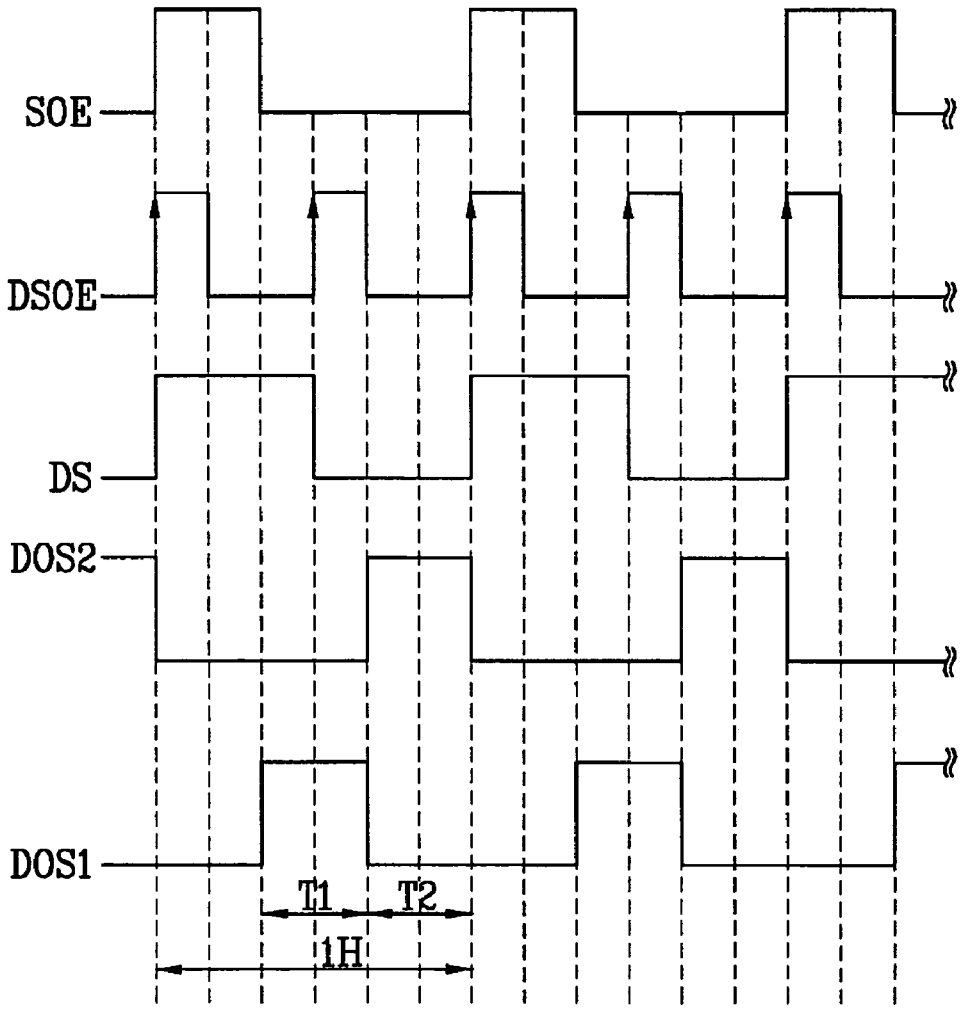
FIG. 8 is a driving timing view of a data output signal generator shown in FIG. 7.

FIG. 7 is a block diagram schematically illustrating a data output signal generator according to an embodiment of the present invention, and FIG. 8 is a driving timing view of a data output signal generator shown in FIG. 7. Referring to FIG. 7 in association with FIG. 8, the data output signal generator 112 includes a source output enable multiply unit 200, a delay unit 210, and first and second data output signal generating units 220 and 230.

The source output enable multiply unit 200 multiplies the source output enable (SOE) by two, providing two DSOE signals for every single SOE signal, and supplies the multiplied source output enable (DSOE) to the delay unit 210 and the second data output signal generating unit 220, respectively.

The delay unit 210 delays the source output enable (SOE) according to an output signal (DSOE) from the source output enable multiply unit 200, and supplies the delayed signal to the second data output signal generating unit 220. That is, the delay unit 210 delays the source output enable (SOE) according to a rising edge of the multiplied source output enable (DSOE).

The second data output signal generating unit 220 logically operates on the output signal (DSOE) of the source output enable multiply unit 200, and the output signal (DS) of the delay unit 210 to thereby generate the second data output signal (DOS2). For example, the second data output signal generating unit 220 may include a NOR-operation gate that generates the second data output signal (DOS2) with a high state only when both of the input signals (DSOE and DS) to the NOR-operation gate are in the low state.

The first data output signal generating unit 230 logically operates on the source output enable (SOE) and the second data output signal (DOS2) to thereby generate the first data output signal (DOS1). For example, the first data output signal generating unit 230 may include a second NOR-operation gate that generates the first data output signal (DOS1) having the high state only when both of the input signals (SOE and DOS2) to the second NOR-operation gate are in the low state.

The data output signal generator 112 supplies the first data output signal (DOS1) having the high state to the modulator 140 during an initial time period (T1) of the data output of source output enable (SOE) supplied by one horizontal period (1H), and supplies the second data output signal (DOS2) of the high state to the modulator 140 during the remaining time period (T2) excluding the initial time period (T1) on the data output of source output enable (SOE). In the illustrated embodiment, the initial time period (T1) is substantially equal in duration to the remaining time period (T2).

In FIG. 6, the gamma voltage generator 115 generates $2^i$ gamma voltages (GV), each gamma voltage distinct from one another and then supplies the generated $2^i$ gamma voltages to the DAC 150. For example, the distinct gamma voltages may be generated by dividing a gamma reference voltage (GMA) supplied from a gamma reference voltage generator by each of the i-bit gray scale numbers.

The shift register 120 generates a sampling signal (Sam) by sequentially shifting the first enable signal (EN1) supplied from the control block 110 in response to the clock signal (CLK) of the control block 110, and supplies the sampling signal (Sam) to the latch 130.

The latch 130 latches i-bit input data (Data), provided from the control block 110, for one horizontal line based on the sampling signal provided from the shift register 120. The latch 130 supplies i-bit data (RData) latched for one horizontal line in response to the source output enable (SOE) to the modulator 140.

Figure 9:
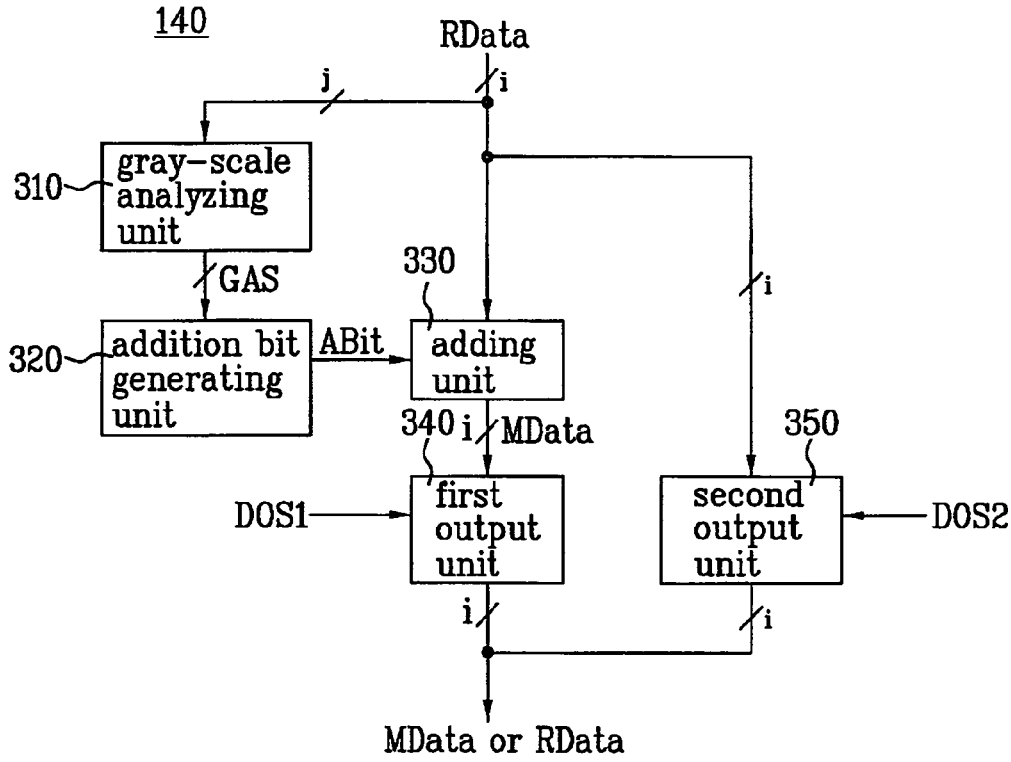
FIG. 9 is a block diagram schematically illustrating a modulator according to an embodiment of the present invention.

As shown in FIG. 9, the modulator 140 includes a gray-scale analyzing unit 310, an addition bit generating unit 320, adding unit 330, and first and second output units 340 and 350.

The gray-scale analyzing unit 310 analyzes at least two most significant bit data (j) of i-bit latch data (RData) supplied from the latch 130, and supplies a gray-scale analyzing signal (GAS) to the addition bit generating unit 330. For example, the gray-scale analyzing unit 310 may generate the gray-scale analyzing signal (GAS) as shown in the following table 2, according to the two most significant bit data of i-bit latch data (RData) supplied from the latch 130.

TABLE 2

| Two most significant bits | Gray-scale analyzing signal (GAS) |
|---|---|
| 00 | 0 |
| 01 | 1 |
| 10 | 2 |
| 11 | 3 |

The addition bit generating unit 320 generates addition bit (ABit) of at least two bits in accordance with the gray-scale analyzing signal (GAS) supplied from the gray-scale analyzing unit 310. For example, as shown in the following table 3, if the gray-scale analyzing signal (GAS) corresponds to '0' or '3', the addition bit generating unit 320 generates the addition bit (ABit) of '001'. If the gray-scale analyzing signal (GAS) corresponds to '1' or '2', the addition bit generating unit 320 generates the addition bit (ABit) of '010'. The following table 3 shows one example of a correspondence between analyzing signal and the generated addition bit (ABit), but the invention may be practicing using correspondences other than that illustrated in table 3. For example, the generation of the addition bit (ABit) may be varied to accommodate different resolutions and liquid crystal operating modes of the LCD panel.

TABLE 3

| Gray-scale analyzing signal (GAS) | Addition bit (ABit) |
|---|---|
| 0 | 001 |
| 1 | 010 |
| 2 | 010 |
| 3 | 001 |

The adding unit 330 adds the addition bit (ABit) of at least two bits provided from the addition bit generating unit 320 to the most significant data of i-bit latch data (RData) provided from the latch 130 to thereby generate i-bit modulated data (MData). The adding unit 330 supplies i-bit modulated data (MData) to the first output unit 340. Accordingly, the gray scale of i-bit modulated data (MData) is larger than the gray scale of i-bit latch data (RData).

In response to the first data output signal (DOS1) of the high state, the first output unit 340 supplies the i-bit modulated data (MData) provided from the adding unit 330 to the DAC 150. In response to the second data output signal (DOS2) of the high state, the second output unit 350 supplies the i-bit latch data (RData) provided from the latch 130 to the DAC 150.

The modulator 140 converts the i-bit latch data (RData) into the i-bit modulated data (MData) for the rapid response speed of liquid crystal in accordance with at least two most significant bit data of the i-bit latch data (RData) supplied from the latch 130. After supplying the i-bit modulated data (MData) to the DAC 150 in response to the first data output signal (DOS1) of the high state, the modulator 140 supplies the i-bit latch data (RData) to the DAC 150 in response to the second data output signal (DOS2) of the high state.

For example, if the latch 130 supplies the latch data (RData) of '011000' to the modulator 140, the modulator 140 generates the addition bit (ABit) of '010' according to the gray-scale analyzing signal (GAS) of '1' corresponding to the two most significant bits of '01' in the latch data (RData) of '011000', and adds the addition data (ABit) of '010' to the three most significant bits of the latch data (RData) of '011000', thereby generating modulated data (MData) of '101000'.

The modulator 140 supplies the modulated data (MData) of '101000' to the DAC 150 while the first data output signal (DOS1) has a the high state during the initial time period (T1) in the data output period of the source output enable (SOE). The modulator 140 supplies the latch data (RData) of '011000' to the DAC 150 while the second data output signal (DOS2) has a the high state during the remaining time period (T2) of the data output period that excludes the initial time period (T1) in the data output period of the source output enable (SOE).

Referring again to FIG. 6, the DAC 150 selects positive and negative polarity gamma voltages (GV) corresponding to the i-bit modulated data (MData) supplied from the modulator 140 among the $2^i$ gamma voltages (GV) having the different values supplied from the gamma voltage generator 115, selects one of the positive and negative polarity gamma voltages (GV) based on the polarity control signal (POL) as the analog video signal (Vmdata), and supplies the analog video signal to the output buffer 160.

The DAC 150 selects positive and negative polarity gamma voltages (GV) corresponding to the i-bit latch data (RData) supplied from the modulator 140 from the $2^i$ gamma voltages (GV) having the different values supplied from the gamma voltage generator 115, selects one of the positive and negative polarity gamma voltages (GV) based on the polarity control signal (POL) as the analog video signal (Vdata), and supplies the selected voltage to the output buffer 160.

The output buffer 160 buffers the analog video signal (Vmdata) corresponding to the i-bit modulated data (MData) supplied from the DAC 150, and supplies the buffered signal to the data lines (DL) during the initial time period (T1) in the data output period of the source output enable (SOE). The output buffer 160 buffers the analog video data (Vdata) corresponding to the i-bit latch data (RData) supplied from the DAC 150, and supplies the buffered signal to the data lines (DL) during the remaining time period (T2) that excludes the initial time period (T1) in the data output period of the source output enable (SOE). The output buffer 160 amplifies and outputs the analog video signal (Vmdata or Vdata) at a suitable level in consideration of the loading on the data lines (DL).

Figure 10:
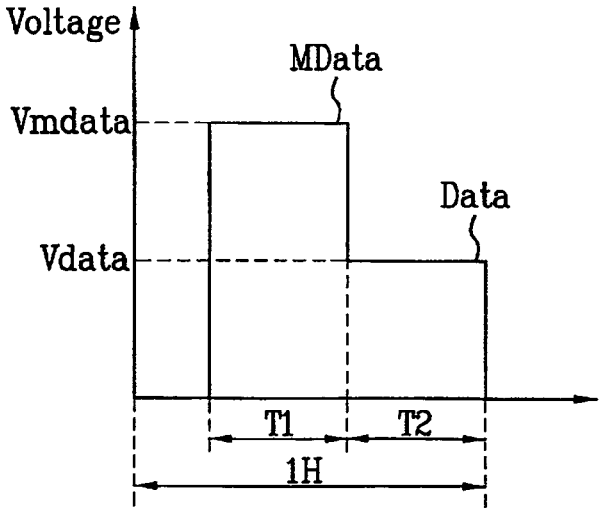
FIG. 10 is a waveform diagram illustrating an analog video signal according to an embodiment of the present invention.

As shown in FIG. 10, after the data driver 6 previously drives the liquid crystal cell with the analog video signal (Vmdata) corresponding to the i-bit modulated data (MData) during the initial time period (T1) in the data output of the source output enable (SOE), the data driver 6 drives the liquid crystal cell with the analog video signal (Vdata) corresponding to the original i-bit input data (Data) during the remaining time period (T2) that excludes the initial time period (T1) in the data output of the source output enable (SOE).

Therefore, in the apparatus and method for driving the LCD device according to the present invention, the gray-to-gray response time of the LCD device substantially the same as one of a black-to-white and a white-to-black response time of the LCD device by reducing actual liquid crystal response time of the LCD device.

As described above, the apparatus and method for driving the LCD device according to the present invention may provide the following advantages.

In the apparatus and method for driving the LCD device according to the present invention, the liquid crystal cell is previously driven by modulating the input data in accordance with at least two bits of the input data, and then the liquid crystal cell is driven to the desired state in accordance with the original input data.

Accordingly, the response speed of liquid crystal for the intermediate gray scale may be increased without using the additional memory to prevent the color change or degradation in picture quality. Further, by allowing the omission of additional memory in an apparatus and method for driving the LCD device according to the present invention the fabrication cost of the LCD device can be decreased.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A data driver for driving a liquid crystal display device having a plurality of data lines comprising:

a modulator that generates modulated data from input data; and a control circuit to selects between converting the modulated data to first analog data of a driving output and converting the input data to second analog data of the driving output, and to supply the driving output to the plurality of data lines, wherein the driving output provides a gray-to-gray response time of the liquid crystal display device substantially the same as one of a black-to-white and a white-to-black response time of the liquid crystal display device by reducing actual liquid crystal response time of the liquid crystal display device.

2. The data driver of claim 1, wherein the control circuit converts the modulated data to first analog data of the driving output during a first portion of a time period and converts the input data to second analog data of the driving output during a second time period substantially not overlapped with the first time period, the control supplying the driving output to the plurality of data lines.

3. The data driver of claim 2, further comprising a data output signal generator that generates first and second data output signals having the different values in response to a control signal supplied from a timing controller;

a shift register that sequentially generates a sampling signal;

a latch that stores the input data as latched data in response to the sampling signal, and wherein the modulator generates the modulated data by combining latched data output from the latch with a modifying data corresponding to at least one most significant bit of the latched data and wherein the control circuit selects between outputting the modulated data as output data and outputting the latched data as output data in response to a first logic state of the first and second data output signals; and a digital-analog unit that converts the output data into an analog video signal and that outputs the analog video signal.

4. The data driver of claim 3, wherein the control signal is a source output enable signal.

5. The data driver of claim 3, wherein the modulator combines the latched data with a modifying value corresponding to at least two most significant bits of the latched data to generate the modulated data and wherein the control circuit selects between outputting the modulated data as output data and outputting the latched data as output data in response to a first logic state of the first and second data output signals.

6. The data driver of claim 3, wherein the first logic state of the first data output signal corresponds to the initial time period of the data output and the first logic state of the second data output signal corresponds to the remaining time period of the data output.

7. The data driver of claim 3, wherein the data output signal generator includes:

a multiplying unit that generates a doubled control signal from the control signal;

a delay unit that outputs a delayed control signal in response to the doubled control signal from the multiplying unit;

a second data output signal generating unit that supplies the second data output signal by logically operating on the doubled control signal from the multiplying unit and the delayed control signal from the delay unit; and a first data output signal generating unit that supplies the first data output signal by logically operating on the second data output signal and the control signal.

8. The data driver of claim 7, wherein the first and second data output signal generating units include NOR-operation gates.

9. The data driver of claim 3, wherein the modulator includes:

an analyzing unit that generates gray-scale data using at least two most significant bit of the latched data;

an addition bit unit that generates the modifying data having at least two bits from the gray-scale data; and an adder that supplies the modulated data by combining the modifying data with the latched data;

a first output unit that outputs the modulated data to the digital-analog unit in response to the first logic state of the first data output signal; and a second output unit that outputs the latched data to the digital-analog unit in response to the first logic state of the second data output signal.

10. The data driver of claim 9, wherein the adder adds the modifying data to the most significant bits of the latched data.

11. The data driver of claim 9, wherein the latched data is identical in number of bits to the modulated data.

12. The data driver of claim 9, wherein the gray scale of the modulated data is larger than the gray scale of the latched data.

13. A data driver for a display device comprising:

a latch that stores input data as latched data in response to a sampling signal;

an analyzing unit that generates gray-scale data based on at least two most significant bits of the latched data;

a data generating unit that generates modifying data of at least two bits from the gray-scale data;

an adder that generates modulated data by adding the modifying data to the latched data;

a first output unit that supplies the modulated data to a digital-analog converter in response to the first logic state of first data output signal as first output data; and a second output unit that outputs the latched data to the digital-analog converter in response to the first logic state of a second data output signal as second output data.

14. The data driver of claim 13, wherein the first output data and the second output data is applied to a plurality of data lines of a display device to provide a gray-to-gray response time for the display device substantially the same as one of a black-to-white and a white-to-black response time for the display device by reducing liquid crystal response time of the display device.

15. The data driver of claim 13, wherein the adder adds the modifying data to most significant bits of the latched data.

16. The data driver of claim 13, wherein the latched data is identical in number of bits to the modulated data.

17. The data driver of claim 13, wherein the gray scale of the modulated data is larger than the gray scale of the latched data.

18. The data driver of claim 13, wherein the first output unit supplies the modulated data to the digital-analog converter during a first portion of a time period and the second output unit supplies the latched data to the digital-analog converter during a second time period substantially not overlapped with the first time period.

19. A data driver for a display device comprising:

a data output signal generator that generates first and second data output signals having the different values in response to a control signal supplied by a timing controller;

a latch that holds input data as latched data in response a sampling signal;

a modulator that generates modulated data by combining input data with modifying data corresponding to at least two most significant bits of the latched data; and a control circuit that selects between outputting the modulated data and outputting the latched data in response to a first logic state of the first and second data output signals to generate driving output data.

20. The data driver of claim 19, wherein the control signal is a source output enable signal.

21. The data driver of claim 19, wherein the driving output data provides a gray-to-gray response time of a display device substantially the same as one of a black-to-white and a white-to-black response time of the display device by reducing actual liquid crystal response time of the display device.

22. A method for driving a liquid crystal display (LCD) device having an image display unit including a plurality of liquid crystal cells formed in areas defined by a plurality of gate and data lines comprising:

generating modifying data from at least one most significant bit of input data;

generating modulated data by combining input data with the modifying data;

selecting between converting the input data into an analog video signal and converting the modulated data into the analog video signal;

and supplying the analog video signal to the data lines, wherein a gray-to-gray response time of the LCD device is made substantially the same as one of a black-to-white and a white-to-black response time of the LCD device by reducing actual liquid crystal response time of the LCD device.

23. The method of claim 22, wherein generating modifying data from at least one most significant bit of input data includes generating modifying data from at least two most significant bit of input data.

24. The method of claim 22, wherein selecting between selecting between converting the input data into an analog video signal and converting the modulated data into the analog video signal includes:

supplying an analog video signal converted from the modulated data to the data lines during a first time portion of a time period of data output, and supplying an analog video signal converted from the input data to the data lines during a second portion of the time period substantially non overlapped with the first time period of data output.

25. The method of claim 22, wherein selecting between converting the input data into an analog video signal and converting the modulated data into the analog video signal includes:

generating first and second data output signals having differing logic states from a control signal, sequentially generating a sampling signal;

latching the input data in response to the sampling signal;

converting the modulated data to analog video signal in response to the first logic state of the first data output signal and converting the latched data to analog video signal in response to the first logic state of the second data output signal and outputting the analog video signal.

26. The method of claim 25, wherein the control signal is a source enable signal.

27. The method of claim 25, wherein the first logic state of the first data output signal corresponds to a first time period of data output, and the first logic state of the second data output signal corresponds to a second period of data output substantially not overlapped with the first time period of data output.

28. The method of claim 25, wherein generating the first and second data output signals includes:

multiplying the control signal by two;

generating a delayed source enable signal in response to the multiplied control signal;

generating the second data output signal by logically operating on the multiplied control signal and the delayed source output enable; and generating the first data output signal by logically operating on the second data output signal and the control signal.

29. The method of claim 28, wherein the logical operating on logically operating on the multiplied control signal and the delayed source output enable corresponds to performing a NOR-operation on the multiplied control signal and the delayed source output enable.

30. The method of claim 28, wherein the logical operating on the second data output signal and the control signal includes performing a NOR-operation on the second data output signal and the control signal.

31. The method of claim 22, wherein generating the modifying data includes:

generating a gray-scale data by analyzing at least one most significant bit the input data; and generating modifying data of at least two bits from the gray-scale data, and, wherein generating modulated data by combining input data with the modifying data includes generating the modulated data by adding the modifying data to the latched data.

32. The method of claim 31, wherein adding the modifying data to the latched data includes adding the modifying data to the most significant bits of the latched data.

33. The method of claim 25, wherein the latched data is identical in number of bits to the modulated data.

34. The method of claim 25, wherein the gray scale of the modulated data is larger than the gray scale of the latched data.

35. An apparatus for driving an LCD device comprising:

an image display unit including a plurality of liquid crystal cells formed in areas defined by a plurality of gate and data lines;

a gate driver to sequentially supply a scan pulse to the gate lines;

a data driver to modulate input data in accordance with the input data, to selectively convert the input data and the modulated input data into an analog video signal, and to supply the analog video signal to the data line; and a timing controller to arrange externally supplied source data, to supply the arranged source data to the data driver, and to control the data driver and the gate driver.

36. The apparatus of claim 35, wherein the data driver is to convert the modulated data into the analog video signal and to supply the converted one to the data line during an initial time period of the data output, and to convert the input data into the analog video signal and to supply the converted one to the data line during a remaining time period exclusive of the initial time period of the data output.

37. The apparatus of claim 36, wherein the data driver comprises:

a data output signal generator to generate first and second data output signals having the different values by using a source output enable supplied from the timing controller;

a shift register to sequentially generate a sampling signal;

a latch to latch the input data in accordance with the sampling signal;

a modulator to generate the modulated data in accordance with the latched input data supplied from the latch, and to selectively output the modulated data and the latched input data in accordance with a first logic state of the first and second data output signals; and a digital-analog converter to convert the modulated data or latched input data supplied from the modulator into the analog video signal, and outputs the converted one.

38. The apparatus of claim 37, wherein the first logic state of the first data output signal corresponds to the initial time period of the data output, and the first logic state of the second data output signal corresponds to the remaining time period of the data output.

39. The apparatus of claim 37, wherein the data output signal generator comprises:

a multiply unit to multiply the source output enable by two;

a delay unit to delay the source output enable in accordance with an output signal of the multiply unit;

a second data output signal generating unit to generate the second data output signal by logically operating on the output signal of the multiply unit and an output signal of the delay unit; and a first data output signal generating unit to generate the first data output signal by logically operating on the second data output signal and the source output enable.

40. The apparatus of claim 39, wherein the first and second data output signal generating units are formed of NOR-operation gates.

41. The apparatus of claim 37, wherein the modulator comprises:

a gray-scale analyzing unit to generate a gray-scale analyzing signal by analyzing at least two most significant bit data of the latched input data;

an addition bit generating unit to generate an addition bit of at least two bits in accordance with the gray-scale analyzing signal;

an adding unit to generate the modulated data by adding the addition bit to the latched input data;

a first output unit to output the modulated data to the digital-analog converter in accordance with the first logic state of the first data output signal; and a second output unit to output the latched input data to the digital-analog converter in accordance with the first logic state of the second data output signal.

42. The apparatus of claim 41, wherein the adding unit is to add the addition bit to the most significant bits of the latched input data.

43. The apparatus of claim 41, wherein the latched input data is identical in number of bits to the modulated data.

44. The apparatus of claim 41, wherein the gray scale of the modulated data is larger than the gray scale of the latched input data.

* * * * *